US005954248A

United States Patent [19]

Jasper

[11] Patent Number: 5,954,248

[45] **Date of Patent: *Sep. 21, 1999**

[54] COMBINATION BACKPACK AND STOOL

[76] Inventor: Harold E. Jasper, 410 Calvin Ave., Winthrop Harbor, Ill. 60096

[ * ] Notice: This patent issued on a continued prosecution application filed under 37 CFR 1.53(d), and is subject to the twenty year patent term provisions of 35 U.S.C. 154(a)(2).

[21] Appl. No.: 08/792,992

[22] Filed: Feb. 3, 1997

[51] Int. Cl.[6] ..... A45F 4/02; A47C 13/00

[52] U.S. Cl. ..... 224/155; 224/628; 297/4; 297/344.18; 297/129; 248/155.1

[58] Field of Search ..... 224/155, 628; 297/129, 130, 4, 188.13, 188.08, 188.18; 248/156, 545, 530, 532, 533, 518, 508, 155.1

[56] References Cited

U.S. PATENT DOCUMENTS

| | | | |
|---|---|---|---|
| 432,560 | 7/1890 | Ray | 297/4 |
| 759,809 | 5/1904 | Farley | 297/4 |
| 3,985,387 | 10/1976 | Rischar | 297/4 |
| 4,085,686 | 4/1978 | Turner et al. | 248/156 |
| 4,248,367 | 2/1981 | Buel . | |
| 4,387,924 | 6/1983 | Fernandez . | |
| 4,773,574 | 9/1988 | Burgard . | |
| 5,186,372 | 2/1993 | Biedenharn, Jr. | 297/129 |
| 5,303,975 | 4/1994 | Asato . | |
| 5,462,213 | 10/1995 | Watt . | |
| 5,499,760 | 3/1996 | Pielocik . | |
| 5,673,966 | 10/1997 | Morton, Jr. | 297/4 |

FOREIGN PATENT DOCUMENTS

| | | | |
|---|---|---|---|
| 599663 | 3/1948 | United Kingdom | 248/155.1 |

*Primary Examiner*—Linda J. Sholl
*Attorney, Agent, or Firm*—Michael R. McKenna

[57] ABSTRACT

A combination backpack and stool with a variable height seat and a grounding mechanism for limiting lateral movement of a sole central column. The lightweight structure has straps for carrying and an integral bag for storage.

34 Claims, 2 Drawing Sheets

COMBINATION BACKPACK AND STOOL

BACKGROUND OF THE INVENTION

This invention relates to a device designed to be used by a bow hunter who hunts on the ground. It may likewise be used by other hunters and fishermen. It is a combination backpack and stool with a seat member disposed on a central column, at least one strap member for carrying, and a container. In a preferred form, it is lightweight, portable and provides a variable height seat that may be removably anchored in the ground.

Alternative technology is available in the form of U.S. Pat. Nos. 4,248,367; 5,303,975; 4,773,574; 5,499,760; and 4,387,924 all of which relate to combination backpacks which require reconfiguration to form a seat. None of these are the single column design. Moreover, these designs require a reconfiguration to establish a seating arrangement, which is not required by the instant invention.

Two other patents require very little reconfiguration. These are U.S. Pat. No. 5,445,301 issued to Biedenharn, Jr. in 1995 for a combination backpack and stool which basically contains a peripheral framing arrangement having a fabric covering and a backpack disposed therein, and further providing a flexible top shelf which may be used as a seat. The other patent requiring no substantial reconfiguration to provide a seat is shown in U.S. Pat. No. 5,462,213 issued to Watt in 1995 for a storage container with carrying straps which has adjustable legs on the bottom portion and a cushion disposed on the top to serve as a seat.

Reference should also be made to U.S. Design patent application Ser. No. 29/042,579, filed Aug. 14, 1995 now abandoned by the applicant herein, which reveals an early design of a bow stalker chair which is distinguishable from the invention claimed herein.

Some of the drawbacks to these designs are that each teaches a substantially more complicated structure to accomplish the objective of combining a seating means with a backpack. Moreover, none of the foregoing inventions is designed to be anchored to the ground as is the device of the present invention. Another disadvantage to the foregoing devices is that they provide for bulky, and thus heavy, frames which can easily fatigue a hunter.

To alleviate this problem, and others which will become apparent from the disclosure which follows, the present invention conveniently provides an adjustable height seat atop a lightweight single column support system and means to anchor the column to eliminate lateral movement and to maintain the position of the device when the user stands to shoot.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach structures that support a user in one position, the instant device allows a user to adjust the seat height so that trees, bushes and other foliage do not block the user's line of sight. Moreover, by having the ability to change the height of the seat, the user can vary the seating position to avoid or lessen leg cramping. More importantly, a bow hunter may prefer to shoot from a seated position and the combination backpack and stool of the instant invention will allow the hunter to remain seated if that is the preference. While seated the means for anchoring stabilizes the central column support system so that its legs do not come out unwantedly.

Should the hunter desire to stand in the act of shooting, the means for anchoring aids in keeping the device erect after the hunter arises. Accordingly, as the users of this apparatus are varied, the device adapts to the preferences of the hunter.

The instant apparatus provides an efficient and convenient means of transporting items that may be stored in the backpack while at the same time serving as a hunter's seat. This apparatus can be formed from a variety of known lightweight materials, such as canvas for the container and straps, plastic for the fasteners, column and seat, and/or metal and woods. The rod is preferably made of stainless steel to avoid corrosion.

Moreover, the apparatus of the present invention is simple in construction and therefore exceedingly lightweight which aids in portability. Thus, this invention provides for the first time a uni-column support system for a seat and backpack with an integral column anchoring means. It will be further appreciated in the broadest application, the invention is nevertheless extremely useful for all backpacking activities.

Still other advantages will be apparent from the disclosure that follows.

SUMMARY OF THE INVENTION

The invention relates to a hunting accessory, a bowman's chair which is portable and easily carried. The present invention discloses a combination backpack and stool comprising a central column with a seat member disposed on one end, at least one strap member operatively connected thereto, and a container disposed adjacent to the central column. Uniquely, the seat member has an adjustable height and an anchoring mechanism.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
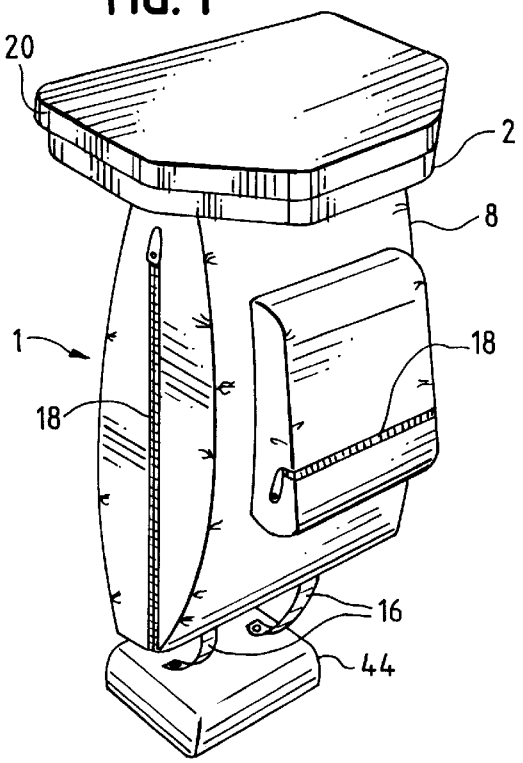
FIG. 1 is a perspective view of a first preferred embodiment of the apparatus for a combination backpack and stool.

The discussion that follows, without limiting the scope of the invention, will refer to the invention as depicted in the drawing, showing an apparatus that will accommodate a bowman while sitting and is lightweight and portable so that it may be carried on the user's back and easily transported.

The preferred embodiments of the apparatus depicted in the drawing comprise a stool and backpack combination having a variable height seat, a footing, a central column, a column stabilizing means that will also keep the device from falling over and adjustable straps.

With respect to the following description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the following is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

As best shown in the drawing, the present invention provides a combination backpack and stool 1 comprising a seat member 2, a central column 4 having a proximate end 4*a* and a distal end 4*b*, the seat member being disposed adjacent to the proximate end of the central column and at least one strap member 6 having a first end 6*a* associated with the proximate end 4*a* of the central column and a second end 6*b* associated with the distal end of the central column. Said combination backpack and stool 1 further comprising a container 8 having at least one internal cavity with the container disposed adjacent to the proximate end 4*a* of the central column 4.

Ideally, the container is a lightweight and durable waterproof canvass knapsack with plastic zippered openings which preferably will generate reduced noise during use. The container can be supported by standard snap fasteners.

Figure 4:
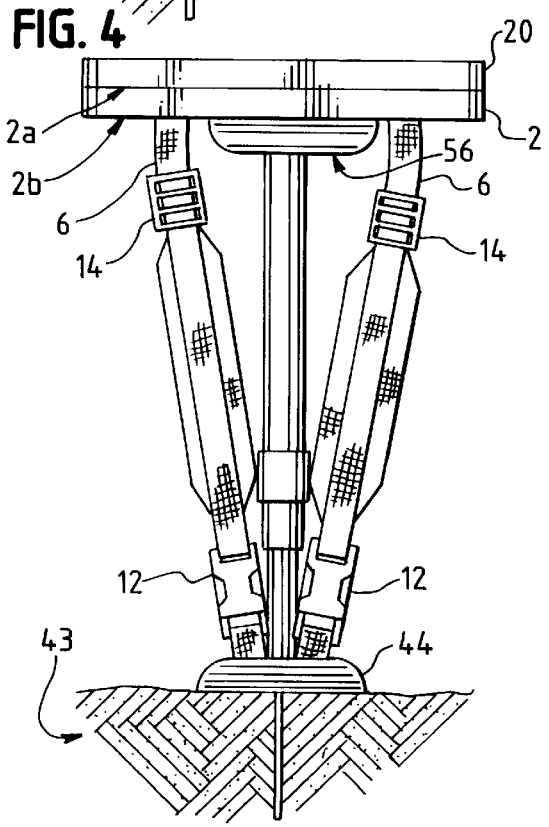
FIG. 4 is a back elevation view of the combination backpack and stool with the container removed for clarity and showing the straps extending between the seat member and the footing with the rod of the means for anchoring extending into the ground.

In a preferred embodiment of the present invention, as shown in FIG. 4, the combination backpack and stool 1 has two strap members 6. Moreover, as will be readily understood by one skilled in the art, each of the at least one strap member 6 of the combination backpack and stool of the present invention may have a reversibly engageable snap fastener 12 and means for modifying 14 the length of the strap.

Figure 2:
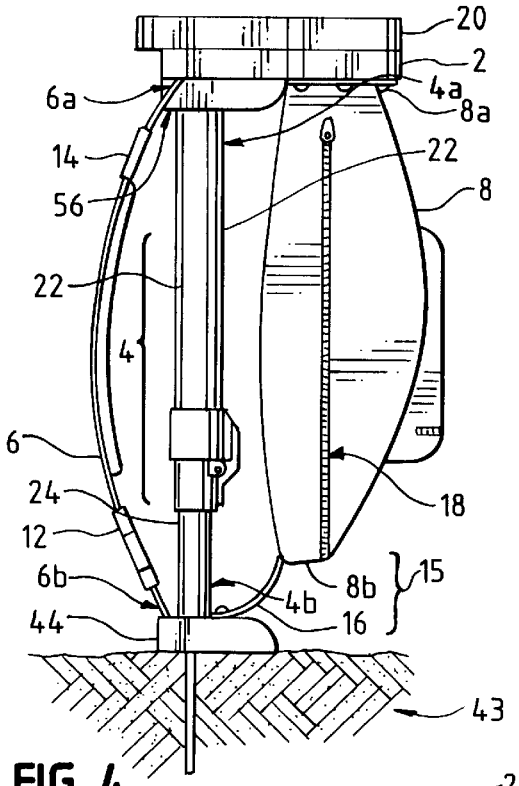
FIG. 2 is a side elevation view of the combination backpack and stool showing particularly means for modifying the length of the strap member and a variable length central column.

In a preferred embodiment of this invention the first end 6*a* of each of the at least one strap member 6 extends from the seat member 2, as shown in FIG. 2.

Figure 3:
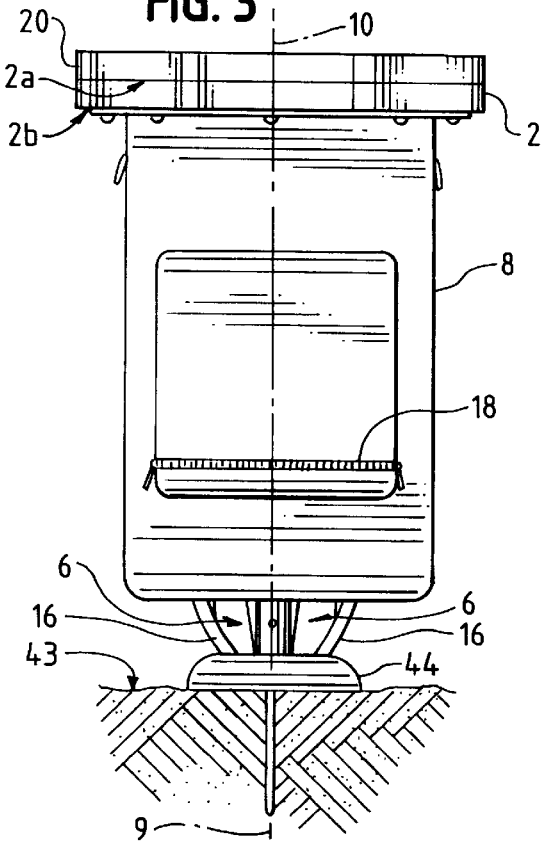
FIG. 3 is a front elevation view of the combination backpack and stool showing symmetry about the central plane.

As shown in FIG. 2 of the drawing, the container 8 has a top end 8*a* associated with the proximate end 4*a* of the central column and a bottom end 8*b* that has means for stabilizing 15 extending from the bottom end 4*b* of the central column. The means for stabilizing comprises at least one tethering strap 16 which may be reversibly associated with the distal end 4*b* of the central column or similarly known equivalent. The straps can be made of a variety of known flexible materials, including leather or canvas, and the fasteners are best made of standard plastic design. Additionally, as illustrated in FIGS. 1, 2 and 3, there is provided at least one closeable opening 18 for each of the at least one internal cavity.

Keeping in mind that the combination backpack and stool 1 of the present invention will be used in bow hunting where the hunter may rise from a seated position to take aim, it is an advantage of the present invention that it is symmetrical about a medial plane 10 in which the longitudinal axis 9 of the central column 4 lies to enhance the balance and stability of the combination backpack and stool so that it will not fall over because of its own weight when the hunter arises. This symmetrical aspect of the invention is best shown in FIG. 3.

In a preferred embodiment of this invention, the seat member 2 has an upper surface 2*a* and a lower surface 2*b*, with the upper surface being generally perpendicular to the longitudinal axis 9 of the central column and the lower surface being associated with the central column. Moreover, a cushion 20 may be disposed on an upper surface 2*a* of the seat member 2.

The combination backpack and stool of this important invention provides for the central column 4 to comprise a first leg 22 and a second leg 24 and means for adjustably connecting 26 the first leg to the second leg. The length of the central column 4 may thus be adjustably varied. In such preferred embodiment of the invention, the first leg 22 of the central column has a proximate end 22*a* and a distal end 22*b*, and the seat member 2 is disposed on the proximate end 22*a* of the first leg. The distal end 22*b* of the first leg is adjustably connected to the proximate end 24*a* of the second leg 24.

Figure 6:
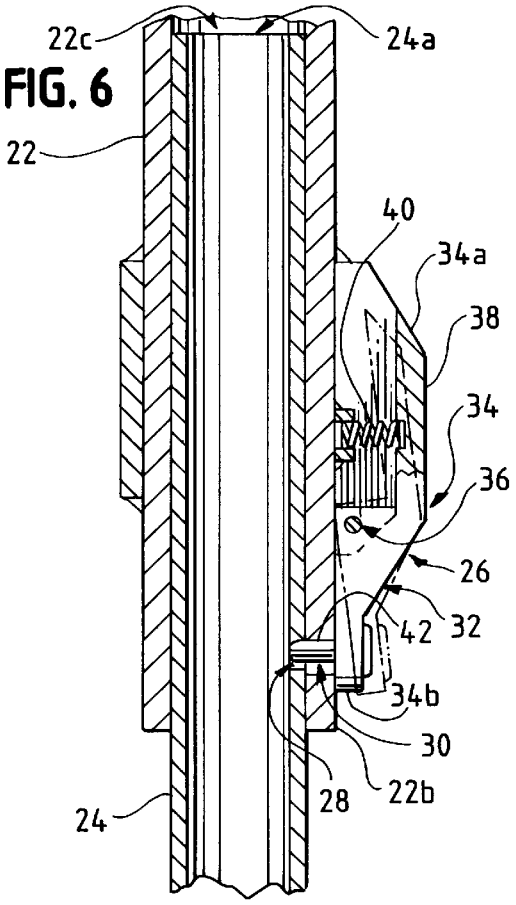
FIG. 6 is a fragmentary cross sectional view taken along the line of 6—6 of FIG. 5 showing the second leg extending inside the hollow of the first leg and the elements of the means for adjustably connecting said legs, said means shown in a first position locking mode and shown, in phantom, in a second position unlocked mode.

In a preferred embodiment of the combination backpack and stool of the present invention best shown in FIG. 6, at least a portion of the distal end 22*b* of the first leg 22 is hollow with a inner diameter that is greater by a predetermined amount than the outer diameter of the second leg 24 and the means for adjustably connecting 26 the first leg 22 to the second leg 26 comprises a plurality of radial holes 28 disposed longitudinally along the second leg 26, a radially disposed aperture 30 adjacent to the distal end 22*b* of the first leg 22, and a locking mechanism 32 fixedly disposed adjacent to the distal end 22*b* of the first leg 22.

The locking mechanism 32 has a pivot arm 34 disposed generally parallel to the longitudinal axis 9 of the central column 4 and pivotable about a pivot axis 36 which is perpendicular to the longitudinal axis 9 of the central column. The pivot arm 34 has a proximate end 34*a* and a distal end 34*b*, respectively disposed on either side of the pivot axis 36, and the proximate end 34*a* has a thumb pad 38 outwardly exposed and means for biasing 40. The distal end 34*b* of the pivot arm has a locking pin 42 extending radially inward. The locking pin is suitably sized and adapted to be inserted into the aperture 30 of the first leg 22 and any one of the plurality of radial holes 28 of the second leg 24 concentrically aligned with the aperture of the first leg when the pivot arm 34 is in a first position, as shown in FIG. 6 of the drawing, thereby locking the first leg to the second leg.

The pivot arm 34 is pivotable between the first position and a second position, shown in phantom lines in FIG. 6, in which the outwardly exposed thumb pad 38 is depressed against the means for biasing 40 causing the locking pin 42 on the distal end 34*b* thereof to be extracted from the any one of the plurality of radial holes 28 of the second leg 24 that is concentrically aligned with the aperture 30 of the first leg 22. Thereby unlocking the first leg 22 from the second leg 24, whereby the length of the central column 4 may be adjusted.

The combination backpack and stool 1 of the present invention may further comprise a footing 44. The footing is disposed adjacent to the distal end of the central column, as best shown in FIGS. 2, 5, 7 and 8. Referring to FIG. 2, the second end 6*b* of each of the at least one strap member 6 extends from the footing 44.

In a preferred embodiment of the combination backpack and stool of the present invention, as shown best in FIG. 2, the footing 44 extends in a cantilevered manner from the central column 4.

As shown in FIGS. 2–4 and 7–8, the combination backpack and stool of the present invention may further comprise means for anchoring 41 the footing 44 to the ground 43 to limit lateral movement of the footing relative to the ground.

Figure 8:
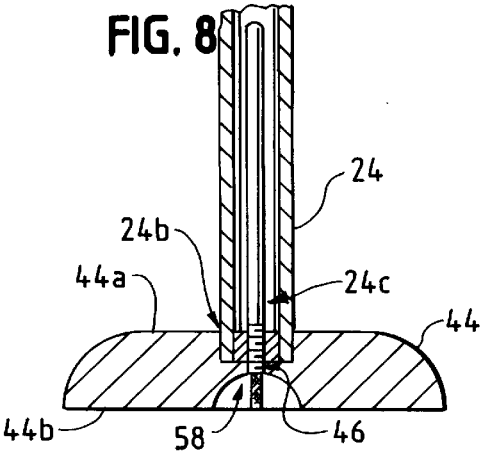
FIG. 8 is a partial cross sectional view of the interconnection of the second leg, the footing, and the rod threadedly disposed in the threaded borehole in the footing with the smooth shank section of the rod disposed inwardly in the bore of the second leg.

In a preferred embodiment of the combination backpack and stool 1, the central column 4 may comprise a first leg 22 and a second leg 24 and means for adjustably connecting 26 the first leg to the second leg, whereby the length of the central column 4 may be adjustably varied. The first leg 22 has a proximate end 22*a* and a distal end 22*b* with a seat member 2 is disposed on the proximate end 22*a* of the first leg 22. The second leg 24 having a proximate end 24*a* and a distal end 24*b*, the footing 44 is disposed on the distal end of the second leg, and the distal end 22*b* of the first leg being adjustably connected to the proximate end 24*a* of the second leg. As best shown in FIG. 8, the footing 44 has an upper surface 44*a* and a lower surface 44*b* with the upper surface being engaged to the second leg 24 and the lower surface 44*b* being generally perpendicular to the longitudinal axis 9 of the central column 4.

As shown in FIG. 6, at least a portion of the distal end 22*a* of the first leg 22 is hollow with a inner diameter that is greater by a predetermined amount than the outer diameter of the second leg 24. The means for adjustably connecting 26 the first leg 22 to the second leg 24 comprises a plurality of radial holes 28 disposed longitudinally along the second leg 24, a radially disposed aperture 30 adjacent to the distal end of the first leg 22, and a locking mechanism 32 fixedly disposed adjacent to the distal end of the first leg 22. The locking mechanism shown in FIG. 6 has a pivot arm 34 disposed generally parallel to the longitudinal axis 9 of the central column and pivotable about a pivot axis 36 which is perpendicular to the longitudinal axis. The pivot arm 34 has a proximate end 34*a* and a distal end 34*b*, respectively disposed on either side of the pivot axis 36. The proximate end 34*a* has a thumb pad 38 outwardly exposed and means for biasing 40, and the distal end 34*b* of the pivot arm has a locking pin 42 extending radially inward. The locking pin is suitably sized and adapted to be inserted into the aperture 30 of the first leg 22 and any one of the plurality of radial holes 28 of the second leg 24 concentrically aligned with the aperture 30 of the first leg 22 when the pivot arm 34 is in a first position, thereby locking the first leg to the second leg. The pivot arm 34 is pivotable between the first position and a second position in which the outwardly exposed thumb pad 38 is depressed against the means for biasing 40 causing the locking pin 42 on the distal end 34*b* thereof to be extracted from the any one of the plurality of radial holes 28 of the second leg that is concentrically aligned with the aperture 30 of the first leg 22. Thereby unlocking the first leg 22 from the second leg 24, whereby the length of the central column 4 may be adjusted.

Referring to FIG. 3, the combination backpack and stool of the present invention is shown with the seat member 2 having an upper surface 2*a* and a lower surface 2*b*. The seat member upper surface 2*a* is generally perpendicular to the longitudinal axis 9 of the central column 4 and the lower surface is operatively associated with the first leg 24.

Figure 5:
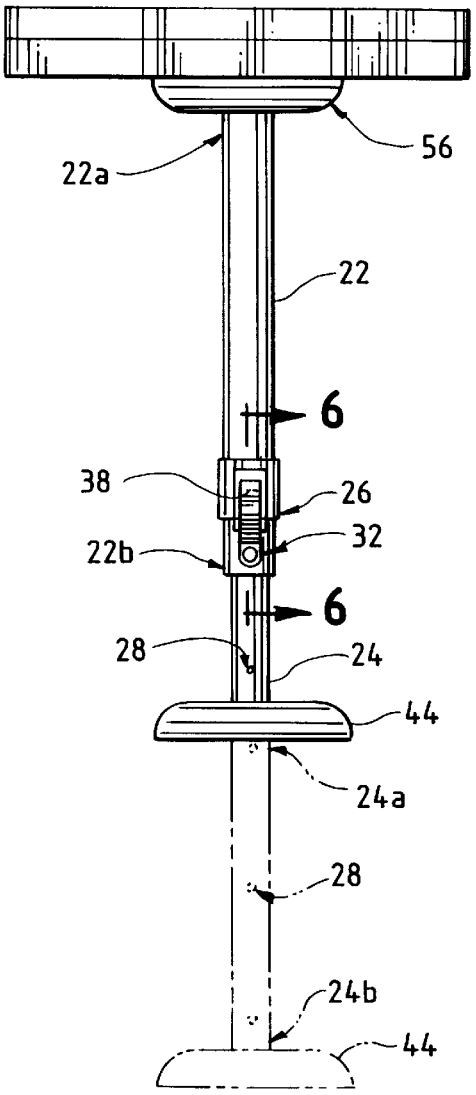
FIG. 5 is a front elevation of the present invention with the container and strap removed and showing the central column having a first leg and a second leg with a means for adjustably connecting the legs together and further showing, in phantom, a position of a second leg when it is extended.

The combination backpack and stool may further comprise a second footing 56 disposed between the seat member 2 and the first leg 22 as shown in FIGS. 2, 4 and 5. The seat member is shown in FIG. 2 extending in a cantilevered manner from the central column 4. The second footing 56 provides additional support for this arrangement.

In a preferred embodiment, means for anchoring 41 the distal end 4*b* of the central column to the ground is provided to limit lateral movement of the central column 4 relative to the ground.

Figure 7:
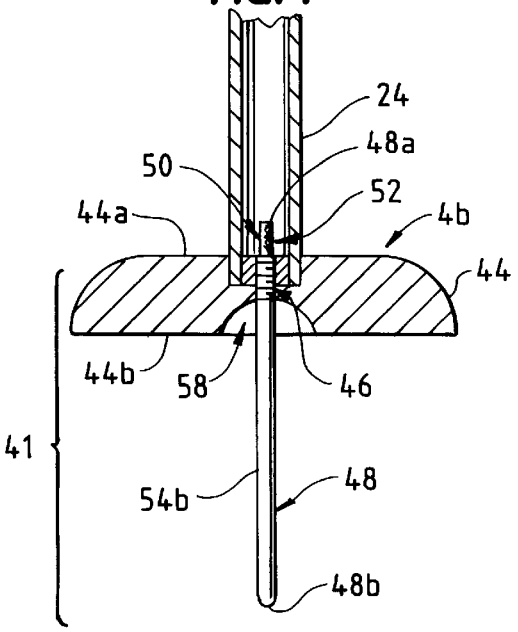
FIG. 7 is a cross sectional view of the interconnection of the second leg, the footing, and the rod threadedly disposed in the threaded borehole in the footing with the smooth shank section extending outwardly where it may engage a patch of ground to laterally stabilize the central column.

As best shown in FIGS. 7 and 8, the means for anchoring comprises a threaded borehole 46 disposed adjacent to the distal end 4*b* of the central column, at least a portion of the distal end 4*b* of the central column comprises a bore 24*c* and a rod 48 having a threaded shank section 50 of suitable diameter to engage the threaded borehole 46 and having sufficient length to extend outwardly from the borehole after having been threadedly fastened therein. The rod 48 is preferably 3/16 inch diameter and approximately 5 inches long with the smooth shank section turned down to 0.150 inch O.D. The threaded borehole 46 has a longitudinal axis concentric with the longitudinal axis 9 of the central column 4. Whereby, when the rod 48 is extending outwardly from the central column it may be inserted in a yielding patch of ground to anchor the combination backpack and stool and limit lateral movement of the central column.

A further preference is manifested with the rod 48 having a proximate end 48*a* and a distal end 48*b*, as shown in FIG. 7, the rod has a knurled shank section 52 between the threaded shank section 50 and the proximate end 48*a*. The rod also has a generally smooth shank section 54 between the threaded shank section 50 and the distal end of the rod 48*b*. The generally smooth shank section 54 is greater in length than the knurled shank section 52. The generally smooth shank section 54 and the knurled shank section 52, both have respective diameters which are less by predetermined amounts than the diameter of the threaded shank section 50, so that each may be pass through the threaded borehole 46 free of restriction.

In this way, when the proximate end 48*a* of the rod is first inserted into the threaded borehole 46 and the rod threadingly engaged in the threaded borehole, the knurled shank section 52 will extend into the bore 24*c* of the central column 4 and the distal end 48*b* of the rod will extend outwardly from the central column 4. When the distal end 48*b* of the rod is first inserted into the threaded borehole 46 and the rod 48 threadingly engaged in the threaded borehole, the generally smooth shank section 54 of the rod will extend inwardly into the bore 24*c* of the central column 4.

Alternatively, an irregularly shaped cross-sectioned rod could function sufficiently, however, the preferred cylindrical threaded rod may more readily be securely engaged to the central column.

In the combination backpack and stool 1 of the instant invention, the means for anchoring 41 may comprise a threaded borehole 46 disposed in the footing 44 and a rod 48 having a threaded shank section 50. The rod has a proximate end 48*a* and a distal end 48*b*, a knurled shank section 52 between the threaded shank section 50 and the proximate end 48*a*, and the rod has a generally smooth shank section 54 between the threaded shank section 50 and the distal end 48*b* of the rod.

The generally smooth shank section 54 is greater in length than the knurled shank section 52. The generally smooth shank section 52 and the knurled shank section 52, each has a diameter which is less by a predetermined amount than the diameter of the threaded shank section 50, so that each may pass through the threaded borehole 46 free of restriction, so that when the proximate end 48*a* of the rod is first inserted in to and threaded in the threaded borehole 46, the distal end 48*b* will extend outwardly from the footing 44 and that when the distal end 48*b* of the rod is first inserted in to and threaded in the threaded borehole 46, the distal end 48*b* of the rod will extend inwardly in to the footing 44.

A preferred embodiment of this invention for a combination backpack and stool provides the footing with a lower surface 44*b* which may be placed in contact with the ground 43 and with the threaded borehole 46 recessed a predetermined distance from the lower surface 44*b* of the footing 44. Additionally, a recess 58 is disposed between the lower surface 44*b* of the footing and the threaded borehole 46. The predetermined distance between the threaded borehole 46 and the lower surface 44*b* of the footing is greater by a predetermined amount than the length of the knurled section 52 of the rod 48.

The recess 58 has a longitudinal axis concentric with the threaded borehole 46 and a transverse dimension in all directions sufficiently greater than the diameter the knurled shank section 52 to permit finger tightening of the knurled surface of the rod 48 within the recess 58. Moreover, the longitudinal axis 9 of the central column 4 is concentric with the threaded borehole 46.

The combination backpack and stool has a bore 24*c* in the distal end 4*b* of the central column extending from the threaded borehole 46 and concentric therewith, with a transverse diameter greater by a predetermined amount than both the diameter of the generally smooth shank section 54 and the diameter of the knurled shank section 52 of the rod 48, so that each may be pass through the bore 24*c* free of restriction. In this manner, when the proximate end 48*a* of the rod is first inserted into the threaded borehole 46 and the rod 48 threaded in the threaded borehole 46, the knurled shank section 52 will extend into the bore 24*c* of the central column and the distal end 48*b* of the rod will extend outwardly from the footing 44; and when the distal end 48*b* of the rod is first inserted into the threaded borehole and the rod 48 threaded in the threaded borehole 46, the generally smooth shank section 54 of the rod will extend inwardly in to the footing 44 and the bore 24*c* of the central column 4.

In a preferred embodiment of the combination backpack and stool of the instant invention, at least a longitudinal section along the distal end of the central column 4 comprises a bore 24*c*, so that any one of the sections of the rod 48 adjacent to the threaded shank 50 may be disposed therein. Furthermore, the threaded borehole 46 may be disposed at a predetermined distance from the distal end 4*b* of the central column and a recess 58 may be disposed between the distal end 4*b* of the central column and the threaded borehole 46, and the predetermined distance between the threaded borehole and the distal end of the central column is greater by a predetermined amount than the length of the knurled section of the rod 48.

The recess 58 has a longitudinal axis concentric with the threaded borehole 46 and a transverse dimension in all directions sufficiently greater than the diameter the knurled shank section 52 to permit finger tightening of the knurled surface of the rod 48 within the recess 58. Whereby, the knurled surface of the rod may be fully disposed within said recess.

In a preferred embodiment of the combination backpack and stool of the present invention, means for anchoring 41 the distal end 4*b* of the central column 4 to the ground 43 to limit lateral movement of the central column relative to the ground are provided with the central column 4 comprising a first leg 22 and a second leg 24 and means for adjustably connecting 26 the first leg to the second leg, whereby the length of the central column 4 may be adjustably varied.

In a last preferred embodiment of the present invention, a combination backpack and stool 1 comprises a central column 4 having a proximate end 4*a* and a distal end 4*b*, a seat member 2 is disposed adjacent to the proximate end 4*a* of the central column, and at least one strap member 6 having a first end 6*a* associated with the proximate end 4*a* of the central column and a second end 6*b* associated with the distal end of the central column. Said combination backpack and stool 1 further comprises a footing 44 disposed adjacent to the distal end 4*b* of the central column. And the footing extends in a cantilevered manner from the central column.

Means for anchoring 41 the distal end 4*b* of the central column to the ground to limit lateral movement of the central column relative to the ground are further provided. The means for anchoring comprises a threaded borehole 46 disposed in the footing 44 and a rod 48 having a threaded shank section 50. The rod has a proximate end 48*a* and a distal end 48*b*, a knurled shank section 52 between the threaded shank section 50 and the proximate end 48*a*, and a generally smooth shank section 54 between the threaded shank section 50 and the distal end 48*b* of the rod.

The generally smooth shank section 54 is greater in length than the knurled shank section 52, and the generally smooth shank section 54 and the knurled shank section 52, each having a diameter which is less by a predetermined amount than the diameter of the threaded shank section 50, so that each may pass through the threaded borehole 46 free of restriction. Whereby, when the proximate end 48*a* of the rod is first inserted in to and threaded in the threaded borehole 46, the distal end 48*b* will extend outwardly from the footing 44, and when the distal end 48*b* of the rod is first inserted in to and threaded in the threaded borehole the distal end of the rod will extend inwardly in to the footing.

The footing 44 has a lower surface 44*b* which may be placed in contact with the ground 43, and wherein the threaded borehole 46 is recessed a predetermined distance from the lower surface 44*b* of the footing and a recess 58 is disposed between the lower surface 44*b* of the footing and the threaded borehole 46. The predetermined distance between the threaded borehole 46 and the lower surface 44*b* of the footing being greater by a predetermined amount than the length of the knurled section 52 of the rod 48.

The recess 58 has a longitudinal axis concentric with the threaded borehole 46 and having transverse dimensions in all directions sufficiently greater than the diameter of the knurled shank section 52 to permit finger tightening of the knurled surface of the rod 48 within the recess 58. The longitudinal axis of the central column 4 is concentric with the threaded borehole 46, and wherein a bore 24*c* in the distal end 4*b* of the central column 4 extending from the threaded borehole and concentric therewith has a transverse diameter greater by a predetermined amount than both the diameter of the generally smooth shank section 54 and the diameter of the knurled shank section 52 of the rod, so that each may pass through the bore 24*c* free of restriction, whereby, when the proximate end 48*a* of the rod is first inserted into the threaded borehole 46 and the rod 48 threaded in the threaded borehole 46, the knurled shank section 52 will extend into the bore 24*c* of the central column 4 and the distal end 48*b* of the rod will extend outwardly from the footing 44, and when the distal end 48*b* of the rod is first inserted into the threaded borehole 46 and the rod threaded in the threaded borehole the generally smooth shank section 54 of the rod will extend inwardly in to the footing and the bore of the central column.

At least a longitudinal section along the distal end of the central column 4 is hollow, so that any one of the sections of the rod 48 adjacent to the threaded shank may be disposed therein. The threaded borehole 46 is disposed at a predetermined distance from the distal end 4*b* of the central column and a recess 58 is disposed between the distal end of the central column 4 and the threaded borehole 46, the predetermined distance between the threaded borehole and the distal end 4*b* of the central column is greater by a predetermined amount than the length of the knurled section 52 of the rod.

The recess 58 has a longitudinal axis concentric with the threaded borehole 46 and having transverse dimensions in all directions sufficiently greater than the diameter the knurled shank section 52 to permit finger tightening of the knurled surface of the rod 48 within the recess 58. Furthermore, the at least one strap member 6 comprises two straps; the central column 4 has a longitudinal axis 9 lying in a medial plane about which the combination backpack and stool 1 is symmetrical; each of the straps has a reversibly engagable snap fastener 12 and means for modifying 14 the length of the strap; the container 8 has a top end 8*a* associated with the proximate end 4*a* of the central column and a bottom end 8*b* that has means for stabilizing 15 extending therefrom, the means for stabilizing comprises at least one tethering strap 16, as shown in FIG. 2, which may be reversibly associated with the distal end 4*b* of the central column; the first end 6*a* of each of the straps extend from the seat member 2 and the second end 6*b* of each of the straps extend from the footing 44; the at least one internal cavity has at least one closeable opening 18 for each of the at least one internal cavity; the seat member has an upper surface 2*a* and a lower surface 2*b*, the seat member upper surface 2*a* is generally perpendicular to the longitudinal axis 9 of the central column 4 and the lower surface 2*b* is associated with the central column 4 and further comprising a cushion 20 disposed on an upper surface 2*a* of the seat member 2, and the seat member extends in a cantilevered manner from the central column 4; and the central column 4 comprises a first leg 22 and a second leg 24 and means for adjustably connecting 26 the first leg to the second leg, whereby the length of the central column 4 may be adjustably varied.

The first leg 22 has a proximate end 22*a* and a distal end 22*b*. The seat member 2 is disposed on the proximate end 22*a* of the first leg, and the distal end 22*b* of the first leg is adjustably connected to the proximate end 24*a* of the second leg, and at least a portion of the distal end 22*b* of the first leg is hollow with a inner diameter that is greater by a predetermined amount than the outer diameter of the second leg 24 and wherein the means for adjustably connecting 26 the first leg 22 to the second leg 24 comprises a plurality of radial holes 28 disposed longitudinally along the second leg 24, a radially disposed aperture 30 adjacent to the distal end 22*b* of the first leg, and a locking mechanism 32 fixedly disposed adjacent to the distal end 22*b* of the first leg with the locking mechanism having a pivot arm 34 disposed generally parallel to the longitudinal axis 9 of the central column 4 and pivotable about a pivot axis 36 which is perpendicular to the longitudinal axis 9.

The pivot arm 34 having a proximate end 34*a* and a distal end 34*b*, respectively disposed on either side of the pivot axis 36, the proximate end 34*a* having a thumb pad 38 outwardly exposed and means for biasing 40, including a compressed spring, and the distal end 34*b* of the pivot arm having a locking pin 42 extending radially inward. The locking pin is suitably sized and adapted to be inserted into the aperture 30 of the first leg 22 and any one of the plurality of radial holes 28 of the second leg 24 concentrically aligned with the aperture 30 of the first leg 22 when the pivot arm 34 is in a first position, thereby locking the first leg to the second leg.

The pivot arm 34 is pivotable between the first position and a second position in which the outwardly exposed thumb pad is depressed against the means for biasing causing the locking pin on the distal end thereof to be extracted from the any one of the plurality of radial holes of the second leg that is concentrically aligned with the aperture of the first leg, thereby unlocking the first leg from the second leg, whereby the length of the central column may be adjusted. Lastly, this preferred embodiment has a container 8 having at least one internal cavity with the container disposed adjacent to the proximate end 4*a* of the central column 4.

The invention resides not in any one of these features per se, but rather in the particular combination of all of them herein disclosed and claimed and it is distinguished from the prior art in this particular combination of all of its structures for the function specified.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Further, the purpose of the following abstract is to enable the U.S. Patent and Trademark Office and the public generally, and especially the scientist, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed as being new and desired to be protected by Letters Patent of the United States is as follows:

1. A combination backpack and stool comprising:

a. a seat member having a first end and an opposing second end;

b. column having a proximate end and a distal end, the seat member having a fixed end and a cantilevered end with its fixed end being immovably disposed relative to and adjacent to the proximate end of said column, said column is disposed medially between the first end and the opposing second end of the seat member, whereby, the seat member is cantilevered from the column;

c. at least one strap member having a first end associated with the proximate end of said column and a second end associated with the distal end of said column; and d. a container having at least one internal cavity, said container being disposed adjacent to the proximate end of said column.

2. The combination backpack and stool of claim 1, wherein the at least one strap member comprises two straps.

3. The combination backpack and stool of claim 2, wherein the column has a longitudinal axis lying in a medial plane about which the combination backpack and stool is symmetrical.

4. The combination backpack and stool of claim 1, wherein each of the at least one strap member has a reversibly engageable snap fastener and means for modifying the length of the strap.

5. The combination backpack and stool of claim 4, wherein the container has a top end associated with the proximate end of said column and a bottom end that has means for stabilizing extending therefrom, said means for stabilizing comprises at least one tethering strap which may be reversibly associated with the distal end of said column.

6. The combination backpack and stool of claim 1, wherein the first end of each of the at least one strap member extends from the seat member.

7. The combination backpack and stool of claim 1, wherein the at least one internal cavity has at least one closeable opening for each of said at least one internal cavity.

8. The combination backpack and stool of claim 1, wherein the seat member has an upper surface and a lower surface, said seat member upper surface being generally perpendicular to the longitudinal axis of the column and said lower surface being associated with the column.

9. The combination backpack and stool of claim 8, further comprising a cushion disposed on an upper surface of the seat member.

10. The combination backpack and stool of claim 1, wherein the column comprises a first leg and a second leg and means for adjustably connecting the first leg to the second leg, whereby the length of the column may be adjustably varied.

11. The combination backpack and stool of claim 1, wherein the column comprises a first leg and a second leg and means for adjustably connecting the first leg to the second leg, whereby the length of the column may be adjustably varied, said first leg having a proximate end and a distal end, the seat member being disposed on the proximate end of said first leg, and the distal end of the first leg being adjustably connected to the proximate end of the second leg.

12. The combination backpack and stool of claim 11, wherein at least a portion of the distal end of the first leg is hollow with an inner diameter that is greater by a predetermined amount than the outer diameter of the second leg and wherein the means for adjustably connecting the first leg to the second leg comprises a plurality of radial holes disposed longitudinally along the second leg, a radially disposed aperture adjacent to the distal end of the first leg, and a locking mechanism fixedly disposed adjacent to the distal end of the first leg, said locking mechanism having a pivot arm disposed generally parallel to the longitudinal axis of the column and pivotable about a pivot axis which is perpendicular to said longitudinal axis, said pivot arm having a proximate end and a distal end, respectively disposed on either side of the pivot axis, the proximate end having a thumb pad outwardly exposed and means for biasing, and the distal end of the pivot arm having a locking pin extending radially inward, said locking pin being suitably sized and adapted to be inserted into the aperture of the first leg and any one of the plurality of radial holes of the second leg concentrically aligned with the aperture of the first leg when the pivot arm is in a first position, thereby locking the first leg to the second leg, said pivot arm being pivotable between the first position and a second position in which the outwardly exposed thumb pad is depressed against the means for biasing causing the locking pin on the distal end thereof to be extracted from the any one of the plurality of radial holes of the second leg that is concentrically aligned with the aperture of the first leg, thereby unlocking the first leg from the second leg, whereby the length of the column may be adjusted.

13. The combination backpack and stool of claim 1, further comprising means for anchoring the column to the ground to limit lateral movement of the column relative to said ground.

14. The combination backpack and stool of claim 1, further comprising a footing, said footing being disposed adjacent to the distal end of said column.

15. The combination backpack and stool of claim 14, wherein the second end of each of the at least one strap member extends from the footing.

16. The combination backpack and stool of claim 14, wherein the footing extends in a cantilevered manner from said column.

17. The combination backpack and stool of claim 14, further comprising means for anchoring the footing to the ground to limit lateral movement of the footing relative to said ground.

18. The combination backpack and stool of claim 17, wherein the means for anchoring comprises a threaded borehole disposed in the footing and a rod having a threaded shank section, said rod having a proximate end and a distal end, the rod having a knurled shank section between the threaded shank section and the proximate end, and the rod having a generally smooth shank section between the threaded shank section and the distal end of the rod, said generally smooth shank section being greater in length than the knurled shank section, and the generally smooth shank section and the knurled shank section, each having a diameter which is less by a predetermined amount than the diameter of the threaded shank section, so that each may be pass through the threaded borehole free of restriction, whereby, when the proximate end of the rod is first inserted in to and threaded in the threaded borehole the distal end will extend outwardly from the footing, and when the distal end of the rod is first inserted in to and threaded in the threaded borehole the distal end of the rod will extend inwardly in to the footing.

19. The combination backpack and stool of claim 14, wherein the column comprises a first leg and a second leg and means for adjustably connecting the first leg to the second leg, whereby the length of the column may be adjustably varied, said first leg having a proximate end and a distal end, the seat member being disposed on the proximate end of said first leg, said second leg having a proximate end and a distal end, the footing being disposed on the distal end of said second leg, and the distal end of the first leg being adjustably connected to the proximate end of the second leg.

20. The combination backpack and stool of claim 19, wherein the footing has an upper surface and a lower surface, said upper surface being engaged to the second leg and said lower surface being generally perpendicular to the longitudinal axis of the column.

21. The combination backpack and stool of claim 19, wherein at least a portion of the distal end of the first leg is hollow with an inner diameter that is greater by a predetermined amount than the outer diameter of the second leg and wherein the means for adjustably connecting the first leg to the second leg comprises a plurality of radial holes disposed longitudinally along the second leg, a radially disposed aperture adjacent to the distal end of the first leg, and a locking mechanism fixedly disposed adjacent to the distal end of the first leg, said locking mechanism having a pivot arm disposed generally parallel to the longitudinal axis of the column and pivotable about a pivot axis which is perpendicular to said longitudinal axis, said pivot arm having a proximate end and a distal end, respectively disposed on either side of the pivot axis, the proximate end having a thumb pad outwardly exposed and means for biasing, and the distal end of the pivot arm having a locking pin extending radially inward, said locking pin being suitably sized and adapted to be inserted into the aperture of the first leg and any one of the plurality of radial holes of the second leg concentrically aligned with the aperture of the first leg when the pivot arm is in a first position, thereby locking the first leg to the second leg, said pivot arm being pivotable between the first position and a second position in which the outwardly exposed thumb pad is depressed against the means for biasing causing the locking pin on the distal end thereof to be extracted from the any one of the plurality of radial holes of the second leg that is concentrically aligned with the aperture of the first leg, thereby unlocking the first leg from the second leg, whereby the length of the column may be adjusted.

22. The combination backpack and stool of claim 21, wherein the seat member has an upper surface and a lower surface, said seat member upper surface being generally perpendicular to the longitudinal axis of the column and said lower surface being associated with the first leg.

23. The combination backpack and stool of claim 21, further comprising a second footing disposed between the seat member and the first leg.

24. The combination backpack and stool of claim 1, further comprising means for anchoring the distal end of the column to the ground to limit lateral movement of the column relative to said ground.

25. The combination backpack and stool of claim 24, wherein the means for anchoring comprises a threaded borehole disposed adjacent to the distal end of the column, at least a portion of the distal end of said column comprises a bore and a rod having a threaded shank section of suitable diameter to engage the threaded borehole and having sufficient length to extend outwardly from said borehole after having been threadedly fastened therein, said threaded borehole having a longitudinal axis concentric with the longitudinal axis of the column, whereby, the rod extending outwardly from the column may be inserted in a yielding patch of ground to anchor the combination backpack and stool and limit lateral movement of the column.

26. The combination backpack and stool of claim 25, wherein the rod has a proximate end and a distal end, the rod having a knurled shank section between the threaded shank section and the proximate end, and the rod having a generally smooth shank section between the threaded shank section and the distal end of the rod, said generally smooth shank section being greater in length than the knurled shank section, and the generally smooth shank section and the knurled shank section, both having respective diameters which are less by predetermined amounts than the diameter of the threaded shank section, so that each may be pass through the threaded borehole free of restriction, whereby, when the proximate end of the rod is first inserted into the threaded borehole and the rod threadingly engaged in the threaded borehole, the knurled shank section will extend into the bore of the column and the distal end of the rod will extend outwardly from the column; and when the distal end of the rod is first inserted into the threaded borehole and the rod threadingly engaged in the threaded borehole, the generally smooth shank section of the rod will extend inwardly into the bore of the column.

27. The combination backpack and stool of claim 1, further comprising means for anchoring the distal end of the column to the ground to limit lateral movement of the column relative to said ground, and wherein the column comprises a first leg and a second leg and means for adjustably connecting the first leg to the second leg, whereby the length of the column may be adjustably varied.

28. A combination backpack and stool comprising:

a. a seat member;

b. a central column having a proximate end and a distal end, the seat member being disposed adjacent to the proximate end of said central column;

c. a footing disposed adjacent to the distal end of said central column;

d. means for anchoring the footing to the ground to limit lateral movement of the footing relative to said ground, the means for anchoring comprises a threaded borehole disposed in the footing and a rod having a threaded shank section, said rod having a proximate end and a distal end, the rod having a knurled shank section between the threaded shank section and the proximate end, and the rod having a generally smooth shank section between the threaded shank section and the distal end of the rod, said generally smooth shank section being greater in length than the knurled shank section, and the generally smooth shank section and the knurled shank section, each having a diameter which is less by a predetermined amount than the diameter of the threaded shank section, so that each may be pass through the threaded borehole free of restriction, whereby, when the proximate end of the rod is first inserted in to and threaded in the threaded borehole the distal end will extend outwardly from the footing, and when the distal end of the rod is first inserted in to and threaded in the threaded borehole the distal end of the rod will extend inwardly in to the footing;

e. at least one strap member having a first end associated with the proximate end of said central column and a second end associated with the distal end of said central column; and f. a container having at least one internal cavity, said container being disposed adjacent to the proximate end of said central column, wherein the footing has a lower surface which may be placed in contact with the ground, and wherein the threaded borehole is recessed a predetermined distance from the lower surface of the footing and a recess is disposed between the lower surface of the footing and the threaded borehole, said predetermined distance between the threaded borehole and the lower surface of the footing being greater by a predetermined amount than the length of the knurled section of the rod, said recess having a longitudinal axis concentric with the threaded borehole and having transverse dimensions in all directions sufficiently greater than the diameter the knurled shank section to permit finger tightening of the knurled surface of the rod within said recess.

29. The combination backpack and stool of claim 28, wherein the longitudinal axis of the central column is concentric with the threaded borehole.

30. The combination backpack and stool of claim 29, wherein a bore in the distal end of the central column extending from the threaded borehole and concentric therewith has a transverse diameter greater by a predetermined amount than both the diameter of the generally smooth shank section and the diameter of the knurled shank section of the rod, so that each may be pass through the bore free of restriction, whereby, when the proximate end of the rod is first inserted into the threaded borehole and the rod threaded in the threaded borehole the knurled shank section will extend into the bore of the central column and the distal end of the rod will extend outwardly from the footing, and when the distal end of the rod is first inserted into the threaded borehole and the rod threaded in the threaded borehole the generally smooth shank section of the rod will extend inwardly in to the footing and the bore of the central column.

31. The combination backpack and stool of claim 30, wherein at least a longitudinal section along the distal end of the central column comprises a bore, so that any one of the sections of the rod adjacent to the threaded shank may be disposed therein.

32. The combination backpack and stool of claim 31, wherein the threaded borehole is disposed at a predetermined distance from the distal end of the central column and a recess is disposed between the distal end of the central column and the threaded borehole, said predetermined distance between the threaded borehole and the distal end of the central column being greater by a predetermined amount than the length of the knurled section of the rod, said recess having a longitudinal axis concentric with the threaded borehole and having transverse dimensions in all directions sufficiently greater than the diameter the knurled shank section to permit finger tightening of the knurled surface of the rod within said recess.

33. A combination backpack and stool comprising:

a. a seat member having a first end and an opposing second end;

b. a column having a proximate end and a distal end, the seat member extends in a cantilevered manner from said column and is immovably disposed relative to and adjacent to the proximate end of said column, said column is disposed medially between the first end and the opposing second end of the seat member;

c. at least one strap member having a first end associated with the proximate end of said column and a second end associated with the distal end of said column; and d. a container having at least one internal cavity, said container being disposed adjacent to the proximate end of said column.

34. A combination backpack and stool comprising:

a. a seat member;

b. a central column having a proximate end and a distal end, the seat member being disposed adjacent to the proximate end of said central column;

c. at least one strap member having a first end associated with the proximate end of said central column and a second end associated with the distal end of said central column; and d. a container having at least one internal cavity, said container being disposed adjacent to the proximate end of said central column;

e. a footing disposed adjacent to the distal end of said central column, said footing extends in a cantilevered manner from said central column;

f. means for anchoring the distal end of the central column to the ground to limit lateral movement of the central column relative to said ground, said means for anchoring comprises a threaded borehole disposed in the footing and a rod having a threaded shank section, said rod having a proximate end and a distal end, the rod having a knurled shank section between the threaded shank section and the proximate end, and the rod having a generally smooth shank section between the threaded shank section and the distal end of the rod, said generally smooth shank section being greater in length than the knurled shank section, and the generally smooth shank section and the knurled shank section, each having a diameter which is less by a predetermined amount than the diameter of the threaded shank section, so that each may be pass through the threaded borehole free of restriction, whereby, when the proximate end of the rod is first inserted in to and threaded in the threaded borehole the distal end will extend outwardly from the footing, and when the distal end of the rod is first inserted in to and threaded in the threaded borehole the distal end of the rod will extend inwardly in to the footing, said footing has a lower surface which may be placed in contact with the ground, and wherein the threaded borehole is recessed a predetermined distance from the lower surface of the footing and a recess is disposed between the lower surface of the footing and the threaded borehole, said predetermined distance between the threaded borehole and the lower surface of the footing being greater by a predetermined amount than the length of the knurled section of the rod, said recess having a longitudinal axis concentric with the threaded borehole and having transverse dimensions in all directions sufficiently greater than the diameter the knurled shank section to permit finger tightening of the knurled surface of the rod within said recess, the longitudinal axis of the central column is concentric with the threaded borehole, and wherein a bore in the distal end of the central column extending from the threaded borehole and concentric therewith has a transverse diameter greater by a predetermined amount than both the diameter of the generally smooth shank section and the diameter of the knurled shank section of the rod, so that each may be pass through the bore free of restriction, whereby, when the proximate end of the rod is first inserted into the threaded borehole and the rod threaded in the threaded borehole the knurled shank section will extend into the bore of the central column and the distal end of the rod will extend outwardly from the footing, and when the distal end of the rod is first inserted into the threaded borehole and the rod threaded in the threaded borehole the generally smooth shank section of the rod will extend inwardly in to the footing and the bore of the central column, at least a longitudinal section along the distal end of the central column is hollow, so that any one of the sections of the rod adjacent to the threaded shank may be disposed therein, the threaded borehole is disposed at a predetermined distance from the distal end of the central column and a recess is disposed between the distal end of the central column and the threaded borehole, said predetermined distance between the threaded borehole and the distal end of the central column being greater by a predetermined amount than the length of the knurled section of the rod, said recess having a longitudinal axis concentric with the threaded borehole and having transverse dimensions in all directions sufficiently greater than the diameter the knurled shank section to permit finger tightening of the knurled surface of the rod within said recess;

and wherein:

g. the at least one strap member comprises two straps;

h. the central column has a longitudinal axis lying in a medial plane about which the combination backpack and stool is symmetrical;

i. each of the straps has a reversibly engagable snap fastener and means for modifying the length of the strap;

j. the container has a top end associated with the proximate end of said central column and a bottom end that has means for stabilizing extending therefrom, said means for stabilizing comprises at least one tethering strap which may be reversibly associated with the distal end of said central column;

k. the first end of each of the straps extend from the seat member and the second end of each of the straps extend from the footing;

l. the at least one internal cavity has at least one closeable opening for each of said at least one internal cavity;

m. the seat member has an upper surface and a lower surface, said seat member upper surface being generally perpendicular to the longitudinal axis of the central column and said lower surface being associated with the central column and further comprising a cushion disposed on an upper surface of the seat member, and the seat member extends in a cantilevered manner from said central column; and n. the central column comprises a first leg and a second leg and means for adjustably connecting the first leg to the second leg, whereby the length of the central column may be adjustably varied, said first leg having a proximate end and a distal end, the seat member being disposed on the proximate end of said first leg, and the distal end of the first leg being adjustably connected to the proximate end of the second leg, and at least a portion of the distal end of the first leg is hollow with an inner diameter that is greater by a predetermined amount than the outer diameter of the second leg and wherein the means for adjustably connecting the first leg to the second leg comprises a plurality of radial holes disposed longitudinally along the second leg, a radially disposed aperture adjacent to the distal end of the first leg, and a locking mechanism fixedly disposed adjacent to the distal end of the first leg, said locking mechanism having a pivot arm disposed generally parallel to the longitudinal axis of the central column and pivotable about a pivot axis which is perpendicular to said longitudinal axis, said pivot arm having a proximate end and a distal end, respectively disposed on either side of the pivot axis, the proximate end having a thumb pad outwardly exposed and means for biasing, and the distal end of the pivot arm having a locking pin extending radially inward, said locking pin being suitably sized and adapted to be inserted into the aperture of the first leg and any one of the plurality of radial holes of the second leg concentrically aligned with the aperture of the first leg when the pivot arm is in a first position, thereby locking the first leg to the second leg, and said pivot arm being pivotable between the first position and a second position in which the outwardly exposed thumb pad is depressed against the means for biasing causing the locking pin on the distal end thereof to be extracted from the any one of the plurality of radial holes of the second leg that is concentrically aligned with the aperture of the first leg, thereby unlocking the first leg from the second leg, whereby the length of the central column may be adjusted.

* * * * *